United States Patent [19]

Nakamura et al.

[11] Patent Number: 4,966,568

[45] Date of Patent: Oct. 30, 1990

[54] COVERED BALLOON

[75] Inventors: Akira Nakamura, Yokohama; Junichi Matsuzawa, Tokyo, both of Japan

[73] Assignee: Takara Kosan Co., Ltd., Tokyo, Japan

[21] Appl. No.: 430,362

[22] Filed: Nov. 2, 1989

[30] Foreign Application Priority Data

Nov. 4, 1988 [JP] Japan ..... 63-144688[U]

[51] Int. Cl.[5] ..... A63H 3/06

[52] U.S. Cl. ..... 446/221; 383/907

[58] Field of Search ..... 446/220, 221, 222, 223, 446/224, 225, 226; 383/907, 3

[56] References Cited

U.S. PATENT DOCUMENTS

| | | | |
|---|---|---|---|
| 1,300,640 | 4/1919 | Pasternak | 446/220 |
| 2,540,403 | 2/1951 | Meyers | 441/221 |
| 2,631,630 | 3/1953 | Brady et al. | 383/903 X |
| 2,635,387 | 4/1953 | Anderson | 446/221 |
| 3,664,058 | 5/1972 | Brieske | 446/226 X |
| 3,814,458 | 6/1974 | Acs | 383/3 X |
| 4,077,588 | 3/1978 | Hurst | 446/226 X |
| 4,778,431 | 10/1988 | Dudley | 446/221 |
| 4,781,645 | 11/1988 | Kato | 446/221 X |
| 4,898,561 | 2/1990 | Nottingham et al. | 446/220 |

FOREIGN PATENT DOCUMENTS

| | | | |
|---|---|---|---|
| 1375573 | 9/1964 | France | 446/226 |
| 1507557 | 12/1967 | France | 446/226 |
| 893680 | 4/1962 | United Kingdom | 446/221 |
| 912716 | 12/1962 | United Kingdom | 446/226 |

*Primary Examiner*—Robert A. Hafer
*Assistant Examiner*—D. Neal Muir
*Attorney, Agent, or Firm*—Spencer & Frank

[57] ABSTRACT

A covered balloon for use as a toy or in a display, which includes a cover formed of a plastic film and a rubber balloon inside the cover. More specifically, the cover is formed of two superposed sheets of substantially gas impervious plastic film whose peripheral edges are welded to form a seam. In a one embodiment, the cover and the rubber balloon each have a nozzle and the rubber balloon is inflated so as to fill the entire space within the cover and eliminate any wrinkles in the cover and adhere to an interior surface of said cover with the nozzle of the rubber balloon protruding from the cover through the nozzle of the cover. A welding flap formed along the seam when the cover is formed by welding together the plastic sheets, may be substantially reduced in size by cutting the flap along the seam. The cover may be formed of a transparent film such as a film of ethylene-vinyl alcohol copolymers so that the rubber balloon inside is visible. According to another embodiment, the rubber balloon fills only a portion of the space within the cover, the remainder being inflated with a gas.

8 Claims, 3 Drawing Sheets

COVERED BALLOON

REFERENCE TO RELATED APPLICATIONS

This application claims the priority of Japan application Ser. No. 63-144688 filed Nov. 4, 1988, which is incorporated herein by reference.

BACKGROUND OF THE INVENTION

The present invention relates to a balloon and more particularly to a balloon with little deflation.

Toy and display balloons have been made of rubber, typically synthetic rubber. Rubber, however, has a porous structure so that the rubber balloon will normally deflate within several days. Such balloons, filled with helium gas instead of air deflate in only one day since helium molecules are much smaller than the oxygen and nitrogen molecules of air.

Polyethylene film and nylon film are also used for balloons. However, there is little difference between the deflation characteristics of polyethylene film and nylon film and those of rubber, in a balloon. In order to prevent the deflation the surface of the polyethylene or nylon film is metalized with aluminum.

It is now common to combine many balloons together to form a decorative display. However, balloons cannot be used in a display for a long period of time unless the problem of deflation is avoided, and while the deflation can be prevented by using aluminum metalized plastic film, prior balloons of this kind have been made up in such a way that a flap-like seam is formed along a weld line where the two sheets of film are welded together. As a result, wrinkles appear on the balloon at the welded portion when the balloon is inflated.

The wrinkles at the balloon body are no problem when the balloon is used as toy, but when combining several balloons together for a display, the wrinkles detract from the appearance. As balloons which are generally spherically shaped are often used for such displays, the wrinkles caused by the aforementioned seams will become a particular problem.

SUMMARY OF THE INVENTION

It is therefore an object of the present invention to provide a balloon which experiences little deflation and which has no wrinkles.

To achieve the above object, the present invention provides a balloon which includes an outer cover formed of a plastic film material which has a substantially non-gas permeable structure and is deformable. The outer cover is formed with two sheets of such plastic film superposed and welded together at their overlaid peripheral edges. A rubber balloon is inserted within the outer cover.

Such a balloon will not have a large seam at the welded part of the outer cover as it is substantially cut away after the welding, leaving visible little more than a small welding line or seam. Consequently, when the covered balloon is inflated, the outer cover will not become wrinkled at the seam.

In accordance with one embodiment of the invention, the rubber balloon inside the outer cover is filled with gas until it mates with the inner surface of the outer cover, in order to make a balloon with an outer cover. In accordance with another embodiment of the invention, a space between the rubber balloon and the outer cover is filled with a gas such as air or helium.

In accordance with a further feature of the invention, the appearance of the covered balloon may be improved by forming the outer cover of a transparent film so that the color and pattern of the rubber balloon within will be visible at the surface.

BRIEF DESCRIPTION OF THE DRAWINGS

These and other features and advantages of the invention will be more fully understood from the following detailed description of the preferred embodiments with reference to the accompanying drawings, in which.

DETAILED DESCRIPTION OF THE PREFERRED EMBODIMENT

Figure 1:
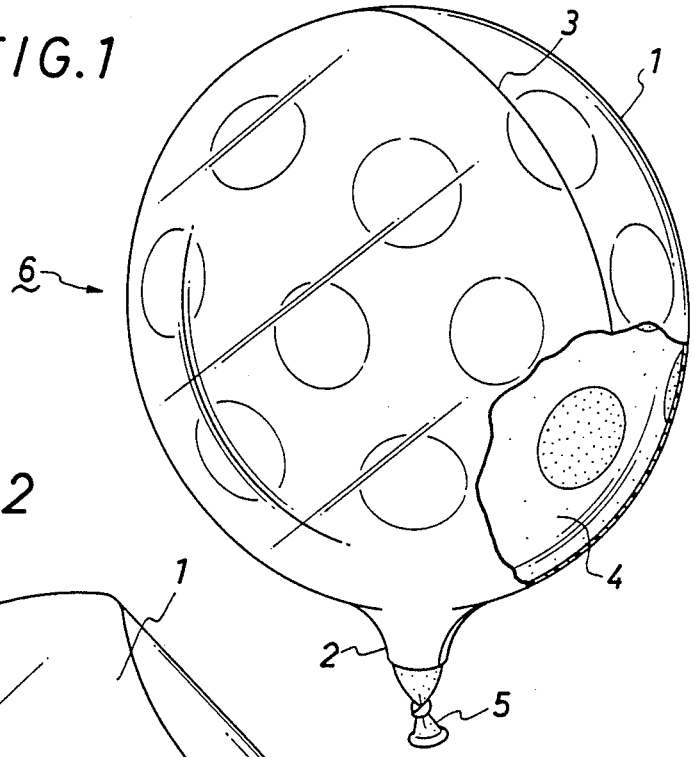
FIG. 1 is a perspective view of an inflated covered balloon according to a first embodiment of the invention, partially broken away for clarity.
Figure 2:
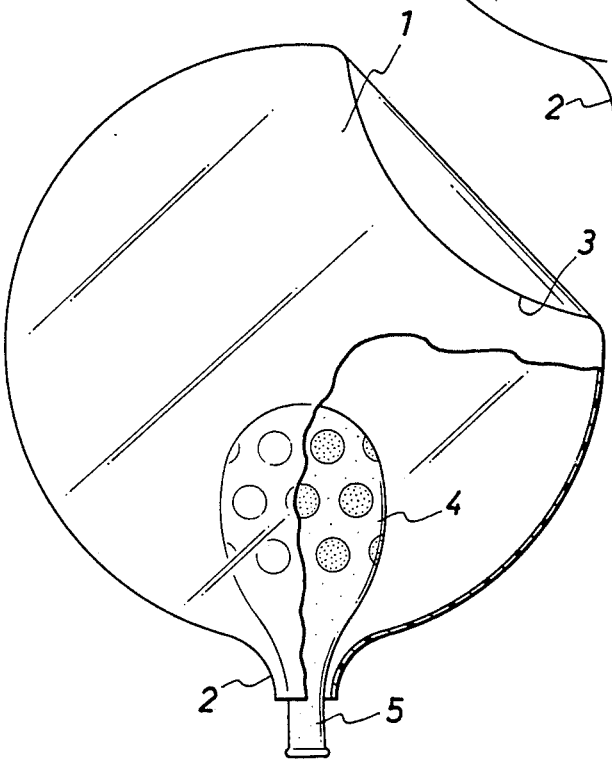
FIG. 2 is a front view of the covered balloon shown in FIG. 1, prior to inflation.

Referring to FIGS. 1 and 2 showing a first embodiment of the covered balloon of the invention, an outer cover 1 is formed by superposing two sheets of plastic film which is a substantially gas impervious structure and is deformable, for example, a film of ethylene-vinyl alcohol copolymers, and by welding them together at overlapping circular peripheral edges. The outer cover 1 is welded along the entire circular edges except for an inlet 2, thereby to form a welded portion 3 having a seam with a welding flap. The flap is cut away from the seam so that the welded portion 3 will be a juncture without wrinkles when the outer cover 1 is inflated as shown in FIG. 1.

For example, in the preferred embodiment using 0.03 mm thick sheets of ethylene-vinyl alcohol copolymers, which are random copolymers of ethylene and vinyl alcohol, (conventionally used as a wrap material for meat because of its high imperviousness to air as well as water), the remaining portion of the flap forming the seam portion 3 is only 0.5 mm wide and thus inconspicuous when the balloon is inflated. The flap formed during welding may be cut away by forcibly pushing a heated knife-like sharp edge against the flap synchronously with the welding. Such a seam is resistant to pressures of some tens of kilograms/$m^2$.

Within the outer cover 1 is a rubber balloon 4 which prior to its inflation is inserted in the outer cover 1 with its nozzle 5 protruding from the inlet 2. The rubber balloon 4 is filled with helium gas or air in a known manner from the nozzle 5, until it mates to the inner surface of the outer cover 1. The outer cover 1 and the rubber balloon 4 together form a balloon body 6. The rubber balloon 4 is inflated until wrinkles on the surface of the outer cover 11 disappear, and thereafter the nozzle 5 is knotted or the nozzle and the inlet 2 are knotted together, to prevent gas leakage.

Since a film of ethylene-vinyl alcohol copolymers is transparent, the color of and the pattern on the rubber balloon 4 will be clearly visible at the surface of the cover 1. The result is a covered balloon which has the appearance of a rubber balloon with a lustrous outer surface. The same effect may also be obtained with transparent films other than a film of ethylene-vinyl alcohol copolymers.

Figure 4:
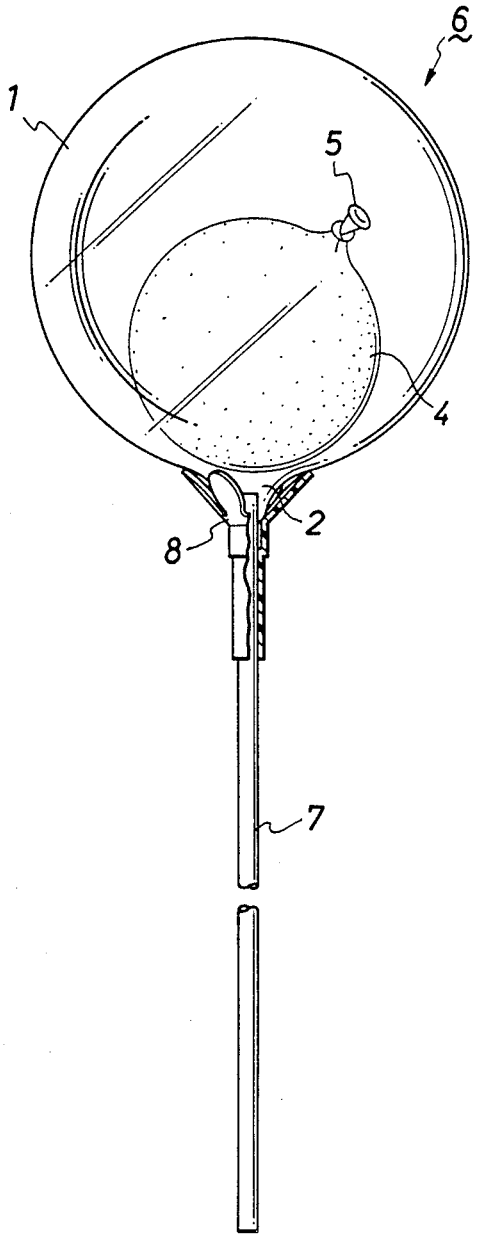
FIG. 4 is a front view showing the inflated covered balloon of FIG. 3 attached to a stick.
Figure 3:
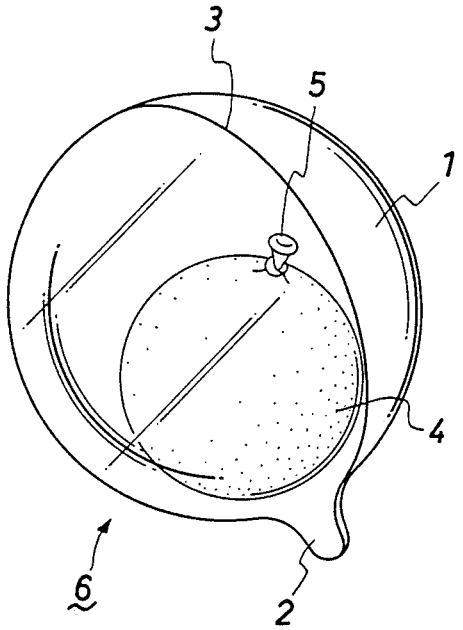
FIG. 3 is a perspective view of an inflated covered balloon according to a second embodiment of the invention.

FIGS. 3 and 4 show a covered balloon 16 in accordance with a second embodiment of the invention. A spherical rubber balloon 14 is inflated inside an outer cover 11 formed of two welded together sheets of plastic film from which a substantial portion of the welded flap has been cut, and knotted at the nozzle 15, and then air is injected between the rubber balloon 14 and the outer cover 11 to inflate the outer cover 11 until its wrinkles disappear. Then, the outer cover 11 is sealed by welding closed the inlet 12.

Similarly to the first embodiment, in the second embodiment, a pleasant appearance of the covered balloon may also be obtained by forming the outer cover 11 of a transparent film such as a film of ethylene-vinyl alcohol copolymers, so that the balloon 14 can be seen through it.

In the second embodiment, the covered balloon will be caused to stay afloat by filling both rubber balloon and outer cover with helium gas. Alternatively, the covered balloon can be caused to stay afloat if the outer cover 11 is so dimensioned that a sufficient volume of helium gas can be injected between the rubber balloon 14 and the outer cover 11 with air being injected in the rubber balloon 14.

Experiments have shown that balloons formed with sheets of 0.03 mm thick sheets of ethylene-vinyl alcohol copolyers are substantially impervious to air and only lightly pervious to hydrogen gas and helium gas. For example, when such a balloon 30 cm in diameter was filled with helium gas, no deflation was observed for about 30 days.

The covered balloon of either embodiment can be attached to a stick 7. An attaching member 8 can be used for reliably fixing the balloon body to the stick 7.

It is to be noted that there is no restriction on the shapes or the ratio of size of the outer cover 11 and the rubber balloon 14. In the embodiment shown, the outer cover is circular so that the covered balloon will be spherical. However, the shape of the covered balloon according to the invention is not limited to a sphere.

Figure 5:
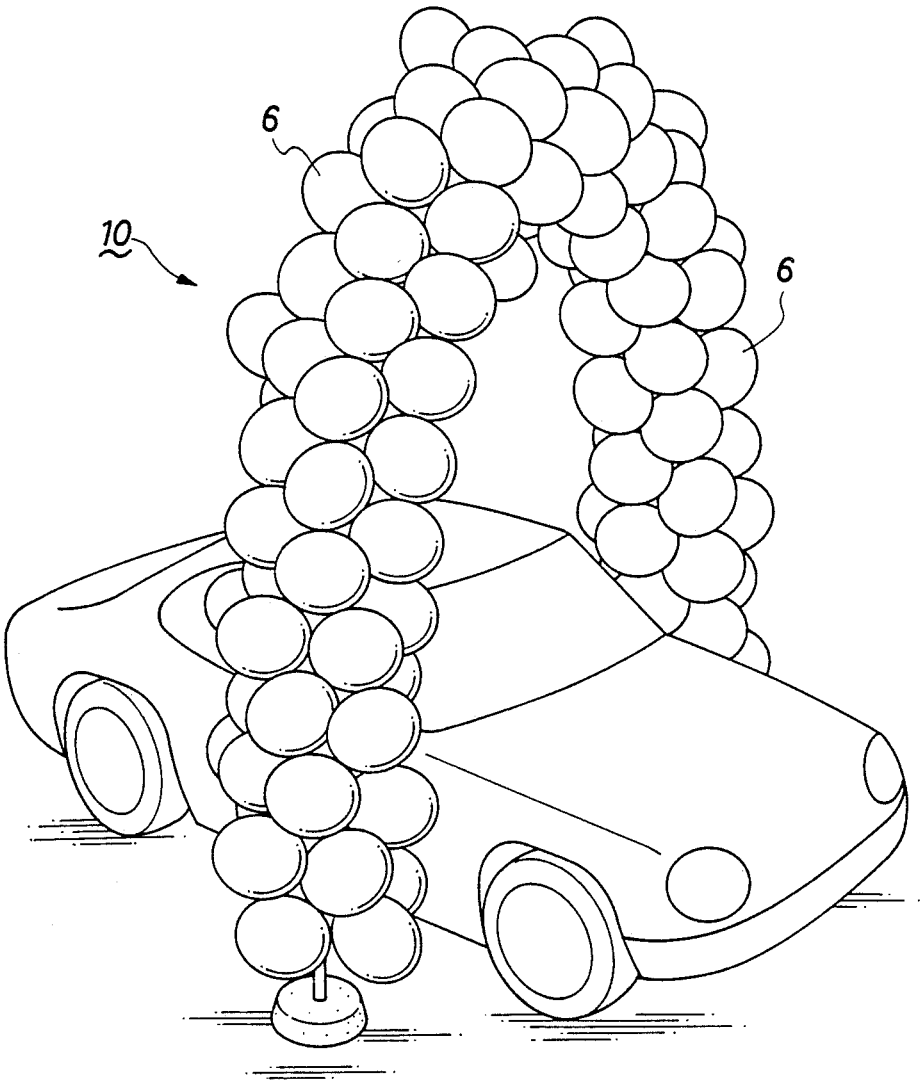
FIG. 5 is a perspective view of a display using covered balloons of the first embodiment.

FIG. 5 illustrates an example of a display using balloons of the first embodiment. A display 10 is made of several covered balloons 6 which are bound together with their nozzles 5 projecting inward. It is of course possible to make a display with balloons formed according to the second embodiment. However, the balloons according to the first embodiment are easier to handle in making such a display because the balloon of this embodiment has a nozzle protruding from the outer cover, and this nozzle is used to bind the balloon to a framework of the display.

It will be understood that the above description of the present invention is susceptible to various modifications, changes and adaptations, and the same are intended to be comprehended within the meaning and range of equivalents of the appended claims.

What is claimed is:

1. A covered balloon, comprising:

a cover having an first nozzle, formed of two sheets of plastic film superposed on one another and having peripheral edges welded together to form a seam, except at the first nozzle, to surround an interior space, said plastic film being substantially gas impervious and being deformable; and a rubber balloon having a second nozzle and an external surface, said rubber balloon being disposed in said interior space, surrounded by said cover, said rubber balloon being inflated so as to fill said interior space, said external surface attaching to an interior surface of said cover, said interior surface surrounding said interior space, said second nozzle protruding from said interior space through said second nozzle.

2. A covered balloon as in claim 1, wherein said seam is substantially free of any welding flap.

3. A covered balloon as in claim 1, wherein said cover is transparent.

4. A covered balloon as in claim 1, wherein said plastic film is formed of a film of ethylene-vinyl alcohol copolymers.

5. A covered balloon, comprising:

a cover having an first nozzle, formed of two sheets of plastic film superposed on one another and having peripheral edges welded together to surround an interior space, said plastic film being substantially gas impervious and being deformable; and a rubber balloon disposed in said interior space, surrounded by said cover, said rubber balloon being inflated so as to fill a first portion of said interior space, a second portion of said interior space being inflated with a gas.

6. A covered balloon as in claim 5, wherein a seam at the welded is substantially free of a welding flap.

7. A covered balloon as in claim 5, wherein said cover is transparent.

8. A covered balloon as in claim 5, wherein said plastic film is formed of a film of ethylene-vinyl alcohol copolymers.

* * * * *